United States Patent [19]

Donnelly

[11] Patent Number: 4,596,114

[45] Date of Patent: Jun. 24, 1986

[54] AIRBORNE SPINNING OR TWISTING RING

[75] Inventor: James E. Donnelly, Gastonia, N.C.

[73] Assignee: Ringtex Industries, Inc., Gastonia, N.C.

[21] Appl. No.: 771,292

[22] Filed: Aug. 30, 1985

[51] Int. Cl.[4] ..... D01H 7/56; D01H 7/58

[52] U.S. Cl. ..... 57/124; 57/75; 57/101; 57/122

[58] Field of Search ..... 57/119, 120, 122, 124, 57/75, 101

[56] References Cited

U.S. PATENT DOCUMENTS

| | | | |
|---|---|---|---|
| 3,324,643 | 6/1967 | Kluttz | 57/124 |
| 3,481,131 | 12/1969 | Chilpan | 57/124 |
| 3,494,120 | 2/1970 | Chilpan et al. | 57/75 |
| 4,030,282 | 6/1977 | Spies | 57/124 |
| 4,270,340 | 6/1981 | Baucom et al. | 57/122 X |
| 4,305,246 | 12/1981 | Donmez et al. | 57/124 |
| 4,316,357 | 2/1982 | Le Chatelier | 57/75 X |
| 4,319,450 | 3/1982 | Igel | 57/124 X |

*Primary Examiner*—John Petrakes

*Attorney, Agent, or Firm*—Shefte, Pinckney & Sawyer

[57] ABSTRACT

A spinning ring member supported on an air bearing between the ring member and a ring holder, the air bearing being formed by an axial passageway between the ring holder and the ring member and upper and lower radial passageways. The upper radial passageway is open and unencumbered, and a barrier element is disposed directly in the path of the air flow through the lower radial passageway to interfere with and partially block such air flow, whereby pressurized air within the axial passageway will flow primarily through the upper radial passageway to impose a lifting force on the ring member. The upper and lower radial passageways are provided by upper and lower facing radial walls on the ring member and the ring holder, respectively, that have an equal axial spacing therebetween to provide simultaneous seating of the ring member at both radial walls when the ring member is at its inoperative or at rest position. An air distribution system is provided which can selectively provide pressurized air to the axial spacing to form the air bearing during operation of the spinning apparatus, and to impose a vacuum within the axial spacing so as to draw the ring member downwardly to is inoperative position when the spinning apparatus is de-energized.

4 Claims, 4 Drawing Figures

AIRBORNE SPINNING OR TWISTING RING

BACKGROUND OF THE INVENTION

This invention relates generally to a rotating spinning ring assembly for spinning and twisting frames, and an improved air bearing arrangement therefor.

The advantage of utilizing freely rotatable spinning rings supported on an air bearing are well-known, such advantages including increased operating speeds and a significant reduction in wear caused by friction inherently present in conventional mechanical bearing assemblies for spinning ring frames. However, despite these advantages, difficulties have been encountered in designing an air bearing arrangement that achieves a properly balanced air flow within the air bearing that will permit a rapid and smooth lifting of the spinning ring when air is first introduced into the air bearing arrangement upon start-up of the operation of the frame, and that reduces undesirable coasting of the spinning ring after the yarn spindle drive is cut off so as to avoid yarn tangling and yarn breakage following such cut off.

Some efforts have been made to improve the air flow characteristics in the basic air bearing arrangement for spinning rings that is believed to be initially disclosed in Klutz U.S. Pat. No. 3,324,643, including a specially formed plenum or air chamber in the air bearing arrangement as disclosed in Baucom et al U.S. Pat. No. 4,270,340 and Chilpan U.S. Pat. No. 3,481,131. One specific feature of the Chilpan ring assembly is the utilization of baffles disposed at the exit ends of both of the radial air flow passageway extending from the point within the air bearing where pressurized air is introduced, these baffles at both air flow passageways being provided for the specific purpose of creating an equal air flow resistance for both passageways so that the air flow through such passageways is balanced or equalized as nearly as possible.

It has been found, however, that when the flow through both of the radial air flow passageways is substantially equalized, there is a significant loss of air flow through the radial passageway at the bottom of the ring, and, therefore, less of the pressurized air introduced into the air bearing is applied to lift the ring member off of the ring holder, particularly at start-up. Consequently, it is necessary in arrangements of the type to use a large air compressor, or other source of pressurized air, which significantly increases the initial costs and operating costs of the apparatus, and which makes it more difficult to stop the rotation of the ring member after the yarn spindle drive is cut off.

In an effort to over come the foregoing drawbacks of equalized air flow through the radial and axial air flow passageways, the above-identified commonly owned Baucom et al patent discloses an air bearing arrangement for a spinning ring in which the pressurized air is admitted into a relatively large, open annular plenum between the ring member and the ring holder, and the axial passageway extending therefrom has a tapered configuration so that the axial spacing increases gradually in the direction toward the radial spacing. While this arrangement is believed to be generally satisfactory in some applications, the uninterrupted flow of pressurized air from the bottom of radial passageways, particularly at start-up, nevertheless requires a relatively large capacity source of compressed air for proper operation of the apparatus in other applications.

In accordance with the present invention, an improved air bearing arrangement is provided which overcomes or alleviates the above-described drawbacks of known airborne spinning and twisting ring devices.

SUMMARY OF THE INVENTION

Briefly summarized, the air-bearing supported spinning or twisting ring apparatus of the present invention includes a ring member received within a ring holder, the ring holder having an axially extending circular wall portion and two radial wall portions extending outwardly and inwardly from the axial wall portion, respectively, the axial spacing between the two radial wall portions being of a predetermined dimension. The ring member is similarly formed with an axially extending circular wall portion spaced from the corresponded axial wall portion of the ring holder to form an air passageway therebetween, and with two radial wall portions extending inwardly and outwardly, respectively, so that surfaces thereof are in facing relation to the corresponding surfaces of the ring holder, and with the axial or vertical spacing between the radial wall portions of the ring member being the same as the spacing between the corresponding radial wall portion of the ring holder. An air distribution arrangement is provided for selectively introducing pressurized air into the spacing between the axial wall portions of the ring member and the ring holder, and an air barrier element is provided only adjacent the radially innermost ends of two lower radial wall portions of the ring holder and the ring member to be directly in the path of air passing therebetween so as to reduce the quantity of air flow and thereby cause a greater quantity of air flow through the open and unencumbered air passageway between the upper radial wall portions of the ring member and the ring holder.

As a result of this arrangement, the quantity of pressurized air required to raise the ring member with respect to the ring holder at start-up of the spinning frame is significantly reduced, and better air consumption characteristics are obtained during normal operation of the apparatus.

In accordance with a further feature of the present invention, the aforesaid construction of the ring member and ring holder is combined with an air distribution arrangement that includes a source of pressurized air, such as a compressor or blower, air conduit means extending between the source and the spacing between the axial wall portions of the ring member and the ring holder, and a valve arrangement within the conduit that is selectively operable between a first position at which the pressure side of the pressurized air source is maintained in fluid communication with the axial wall spacing and a second position at which the suction side of such source is maintained in fluid communication with such spacing. At the second position of the valve arrangement, the suction imposed within the axial spacing, combined with the aforesaid air flow barrier at the lower radial walls of the ring member and the ring holder, will create a vacuum within the axial spacing that tends to draw the ring member to its inoperable or rest position in contact with the ring holder at the desired time interval after the yarn spindle drive is cut off to thereby eliminate or at least substantially reduce undesirable coasting of the ring member that can result in yarn breakage or tangling as discussed above.

DESCRIPTION OF THE PREFERRED EMBODIMENT

Figure 1:
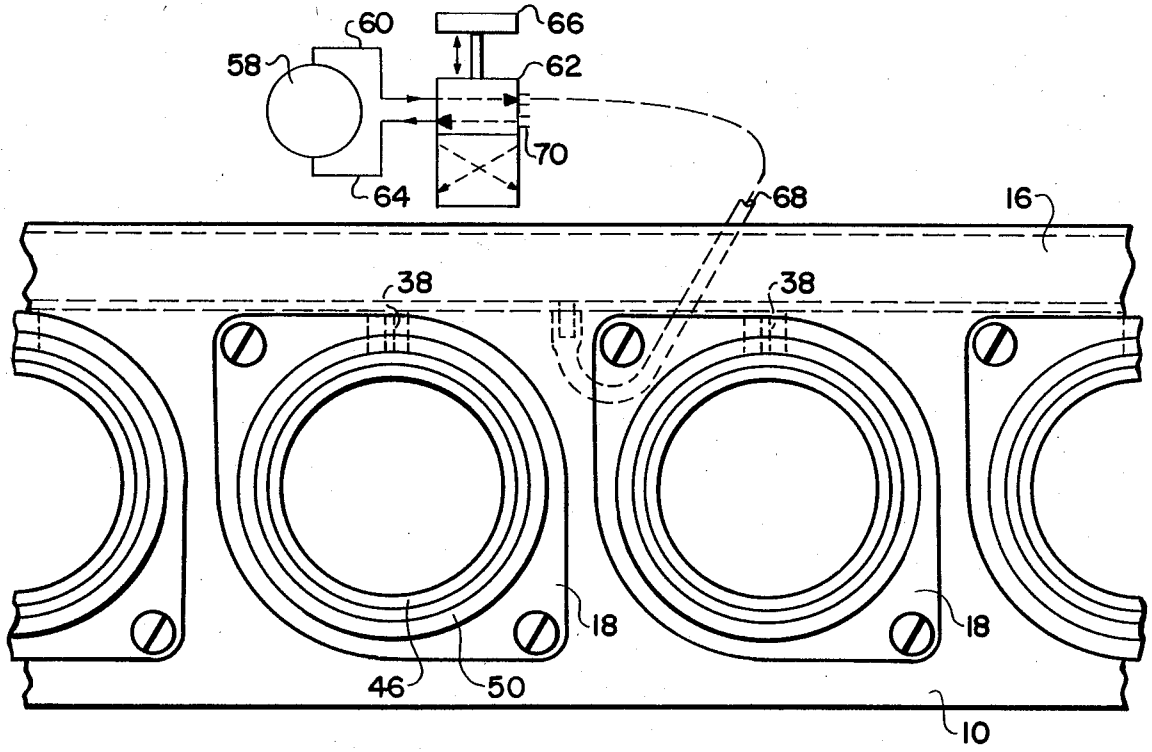
FIG. 1 illustrates a ring rail of a spinning or twisting frame in which the air-bearing arrangement of the present invention is carried with the air distribution system shown partially in diagrammatic form.

Looking now in greater detail at the accompanying drawings, FIG. 1 illustrates a ring rail 10 formed of any suitable material and having a plurality of spaced circular openings, each receiving a ring holder 12 having a ring member 14 mounted therein for rotation, and it will be appreciated that the number of ring holders 12 carried by the ring rail 10 can vary depending on the nature of the particular spinning frame on which the ring rail 10 is mounted. One lengthwise edge of the ring rail 10 is bent or otherwise formed as an enclosed chamber that houses an air plenum 16 which is part of the air distribution system for the plurality of ring holders 12 fitted within the ring rail 10 as will be explained in greater detail below.

Figure 2:
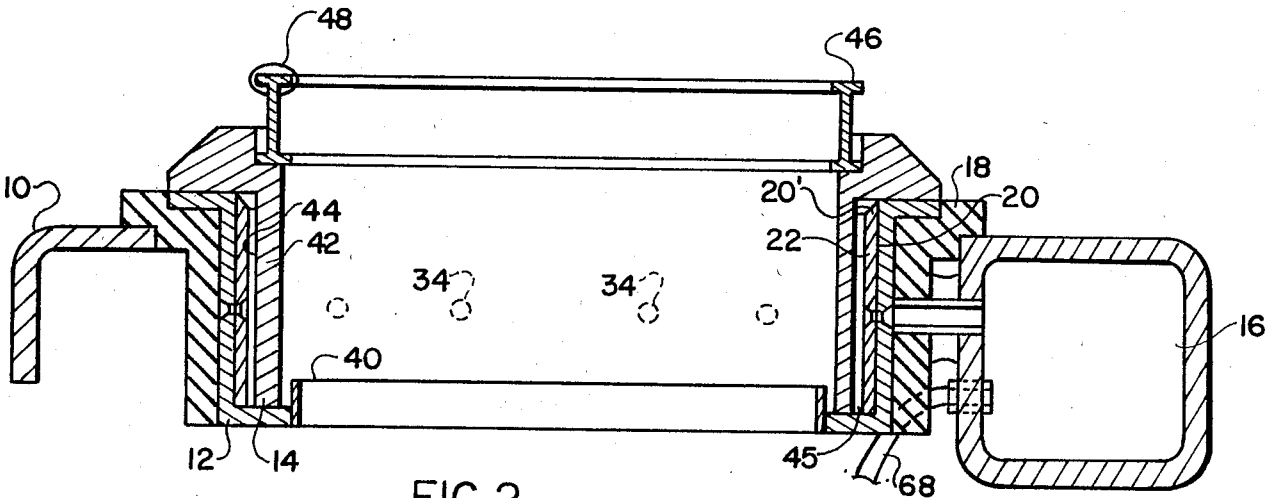
FIG. 2 is a vertical sectional view taken through an axial plane of the air bearing arrangement, with the ring member being shown in its at-rest or non-operating position.
Figure 3:
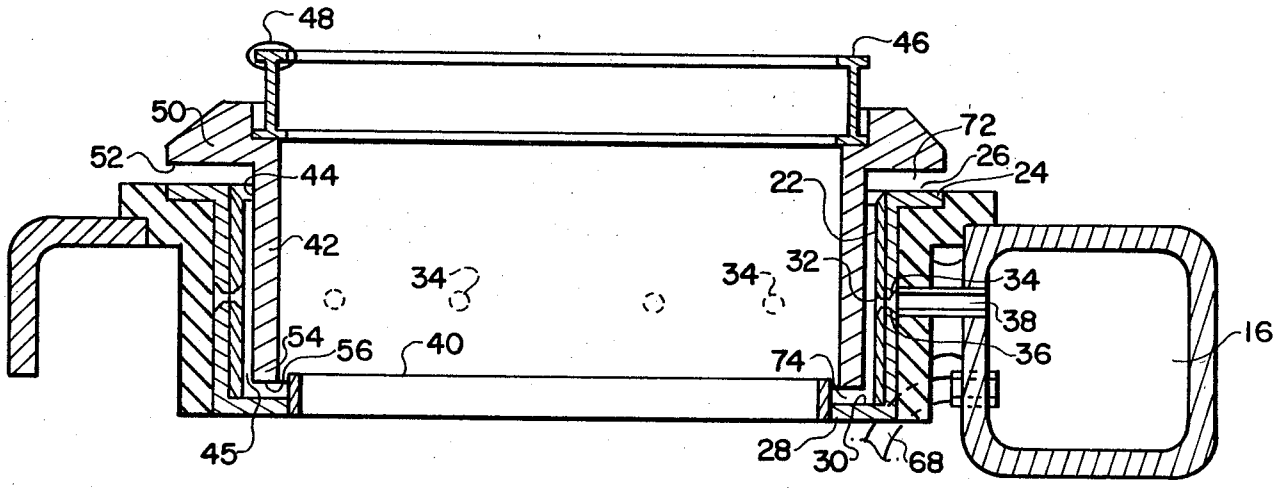
FIG. 3 is a vertical sectional view corresponding to FIG. 2, but illustrating the ring member at its raised or operating position.

As best seen in FIGS. 2 and 3, each ring holder 12 is surrounded by a bushing 18 formed of any suitable elastomeric material so as to absorb any vibrational forces generated by the rotation of the ring member 14 during operation, the bushing 18 being interposed between the ring holder 12 and the ring rail 10 for this purpose. The ring holder 12 includes a cylindrical center portion 20 including, preferably, a Teflon lining 20' that presents an axially extending interior circular wall portion 22, and includes an upper radial wall portion 24 extending outwardly from the circular wall portion 20 to present an upper flat supporting surface 26, and a lower radial wall portion 28 that extends radially inwardly from the circular wall portion 20 to present an upper flat supporting surface 30. At a point generally midway along its axially extending length, the interior surface of the center portion 20 is formed with an annular groove 32 into which a plurality of air openings 34 extend from a similar annular groove 36 formed at the exterior surface of the circular wall portion 22, the groove 36 being covered by bushing 18 through which an air tube 38 extends to communicate with the plenum 16. A relatively short annular element 40 is fixed to the radially innermost end of the lower radial wall 28 so as to extend coaxially with respect to the center portion 20 and to extend upwardly from the lower support surface 30 to form an air barrier thereat as will be explained in greater detail below.

The ring member 14 is freely and rotatably mounted in the ring holder 12, and includes a center portion 42 formed with an axially extending interior cylindrical wall portion 44 disposed with a slight spacing 45 in relation to the interior cylindrical wall portion 22 of the ring holder 12. A spinning ring 46 is received at the top of the ring member 14 and held securely in place thereat by a press fit, and a conventional ring traveler 48 is mounted for sliding engagement around an upper flange of the spinning ring 46, the traveler 48 being capable of receiving yarn therethrough and sliding about the spinning ring 46 during winding of the yarn about a conventional yarn carrier or bobbin (not shown) that is mounted for rotation within the central confines of the ring member 14 in a conventional manner that is well known in the art.

The ring member 14 also includes an upper radial wall portion 50 that extends radially outwardly from the circular wall portion 44 to present an upper support surface 52 disposed in facing relation to the upper supporting surface 26 of the ring holder 12, and a lower radial wall portion 54 that extends radially inwardly from the circular wall portion 44 to present a lower support surface 56 disposed in facing relation to the lower supporting surface 30 of the ring holder 12. The interior cylindrical surface of the center portion 42 of the ring member 14 is slightly spaced from the interior surface of the annular air barrier element 40 as illustrated in FIGS. 2 and 3.

As shown diagrammatically in FIG. 1, the air distribution system of the present invention includes a blower 58 having a conduit 60 extending from its outlet or pressure side to a valve 62, and having a conduit 64 extending from its inlet or suction side to the valve 62. The valve 62 is a conventional double-acting, two-way valve operated by a conventional motor or solenoid operator 66 between a first lower position (shown in FIG. 1) at which the pressure side conduit 60 is placed in fluid communication within a tube 68 extending from the valve 62 to the air plenum 16 to introduce pressurized air thereinto, and a second position at which the valve 62 is raised from its first position shown in FIG. 1 to place the suction side conduit 64 in fluid communication with the tube 68 to impose a vacuum within the plenum 16. An atmospheric port 70 is provided at the valve 62 so that in the first position thereof the suction side conduit 64 draws atmospheric air through the valve 62 to the blower 58, and in the second position thereof the outlet from the blower 58 is exhausted to atmosphere through the pressure side conduit 60, the valve 62, and the port 70. The valve operator 66 may be controlled by any desired and conventional circuit (not shown) to move the valve 62 to its aforesaid first position when the spinning frame is energized, and to move the valve 62 to its aforesaid second position when the spinning or winding cycle has been completed and the spinning frame is de-energized to permit removal of the fully would bobbins.

The operation of the above-described apparatus is as follows. Just prior to start-up or energization of the spinning frame, the ring member 14 is disposed within the ring holder 12 at the position shown in FIG. 2, and it is to be noted here that the ring holder 12 and the ring member 14 are specifically designed so that the axial spacing between the upper and lower supporting surfaces 26,30 of the ring holder 12 has a predetermined dimension (e.g. 1 inch), and so that the corresponding axial spacing between the upper and lower support surfaces 52,56 of the ring member 14 is the same dimension. As a result, when the ring member 14 is disposed at its inoperative or at rest position, it is supported simultaneously by its upper support surface 52 being in full contact with the upper supporting surface 26 of the ring holder 12 and by its lower support surface 56 being in full contact with the lower supporting surface 30 of the ring holder 12. When the spinning frame is initially energized, the valve 62 is at its first position as shown in FIG. 1, and pressurized air from the blower 58 is transmitted to the plenum 16 and to the axial spacing 45 between the ring holder 12 and the ring member 14 through the tube 38. Since, as described above, the lower support surface 56 of the ring member 14 is resting in direct contact with the lower supporting surface 30 of the ring holder 12, little or none of the pressurized air in the spacing 45 can leak or be lost at the bottom end of the ring member 14 and, consequently, virtually all of the force initially exerted by the pressurized air is directed upwardly within the spacing 45 and against the upper supporting surface 52 of the ring member 14 to thereby lift the ring member 14 off of the ring holder 12 to a position as illustrated in FIG. 3. It will be apparent that this initial concentration of the force of the pressurized air solely against the upper supporting surface 52 results in an immediate raising of the ring member 14, and such lifting requires only a relatively small quantity of pressurized air, particularly as compared with conventional air bearing arrangements where the flow of pressurized air from the upper and lower ends of the spacing 45 is essentially equalized as disclosed in the above-discussed Chilpan patent, and as compared with other arrangements such as the above-discussed Baucom et al patent where the lower end of the axial passageway is open to the atmosphere and some pressurized air can escape therethrough. Moreover, after the ring member 14 has been raised to its operating position as shown in FIG. 3 and begins rotating on the air bearing formed between the radial flanges of the ring member 14 and the ring holder 12, the flow of the pressurized air introduced into the spacing 45 is continuously controlled so that the major portion of the pressurized air is forced to flow through the spacing 72 provided between the upper surface 26,52 rather than through the spacing 74 provided between the lower surfaces 30,56. More specifically, the spacing 72 is entirely open and unencumbered so as to permit the free flow of pressurized air therethrough, but the vertical extent of the annular element 40 is disposed directly in the path of flow of pressurized air from the lower spacing 74 so as to form a barrier that interrupts and at least partially blocks the air flowing from the lower spacing 74 and thereby causes a substantially greater flow of pressurized air through the upper spacing 72. Again, the unique arrangement results in maximum utilization of the pressurized air to maintain the ring member 14 at its raised position for free rotation on an air bearing, and, therefore, the required capacity of the blower 58 is significantly reduced as compared to conventional spinning ring air bearing arrangements, which, in turn, significantly reduces the initial capital costs and operating costs of the apparatus of the present invention, but there is sufficient air flow through the lower spacing 74 to maintain the desired air bearing.

In accordance with a further feature of the present invention, the rotation of the ring member 14 can be effectively stopped within a desired time period after the spinning frame is de-energized, thereby avoiding excessive coasting of the ring member 14 that can result in tangling or breakage of the yarn as explained in greater detail in the above-discussed Baucom et al patent, in which this problem is addressed by providing a relatively complex control system that is designed to cut off the flow of pressurized air to the air bearing about four to seven seconds after the spinning frame is de-energized. In the present invention, rather than relying upon a timed cut-off of the pressurized air flow and the consequential sometime inconsistent effect on the coasting rotation of the ring member, a positive force is imposed on the ring member 14 at any desired time to stop the further rotation of the ring member in a relatively short and generally more predictable and desirable time period. In most applications of the present invention, the valve operator 66 will be operated just prior to the de-energization of the spinning frame drive to move the valve 62 to its aforesaid second or raised position whereby the suction side of the blower 58 is placed in fluid communication with the plenum 16 and the axial spacing 45 between the ring member 14 and the ring holder 12 to impose a vacuum therein, and this vacuum will act almost immediately to draw the ring member 14 downwardly into the ring holder 12 so that it returns to its inoperative or at rest position as illustrated in FIG. 2. In this regard, it will be noted, again, that the effective force of the vacuum in drawing down the ring member 14 is maximized by the presence of the annular air barrier element 40 at the lower spacing 74 and the absence of any barrier or other encumberances at the upper radial spacing 72. Thus, when the vacuum is imposed within the axial passageway or spacing 45, the annular barrier element 40 will interfere with or partially block the flow of air drawn inwardly through the lower spacing 74 by the vacuum, but air can be freely drawn in through the upper radial spacing or passageway 72 to impose a downward force on the ring member 14. Moreover, once the ring member 14 is fully drawn into the ring holder to its at rest or inoperative position as shown in FIG. 2, any vacuum within the axial passageway 45 will act almost entirely to impose a downward force on the upper radial support surface 52 of the ring member 14 to hold it in place within the ring holder 12.

Figure 4:
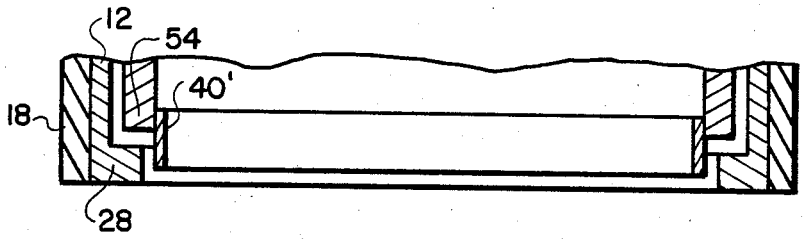
FIG. 4 is a partial view illustrating the lower portion of the air bearing arrangement and an alternate embodiment of the air barrier element.

An alternate embodiment of the present invention is illustrated in FIG. 4, which shows only the lower end of the apparatus where the structural change is incorporated in the apparatus. In this alternate embodiment, all of the elements of the apparatus are the same as those described above, except that the annular barrier member 40 of the FIG. 2 embodiment is eliminated, and an alternative annular barrier member 40' is fixed at the interior cylindrical surface of the center portion 20 of the ring member 14 so as to extend coaxially therewith and to have a vertical dimension that insures it will be disposed directly in the path of the air flow through the lower radial spacing or passageway 74. It will be apparent that the barrier element 40' acts in the identical manner as that described above in connection with the barrier element 40, and that all of the aforesaid advantages of the present invention will be obtained from the alternate embodiment of the invention illustrated in FIG. 4.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. An air-bearing supported spinning or twisting ring apparatus, comprising:

(a) a ring holder formed with an axially extending circular wall portion, a first radial wall portion extending radially outwardly from said circular wall portion to present an upper flat supporting surface, and a second radial wall portion extending radially inwardly from said circular wall portion to present a lower flat supporting surface, with a predetermined axial spacing between said first and second radial wall portions;

(b) a ring member freely rotatably mounted within said ring holder, said ring member being formed with an axially extending circular wall portion disposed in spaced relation to said circular wall portion of said ring holder, a first radial wall portion extending radially outwardly from said ring member circular wall portion to present a first support surface disposed in facing relation to said ring holder upper support surface, and a second radial wall portion extending radially inwardly from said ring member circular wall portion to present a second support surface disposed in facing relation to said ring holder lower support surface, with the axial spacing between said first and second radial wall portions of said ring member corresponding to said predetermined axial spacing between said first and second radial wall portions of said ring holder whereby when said ring member is at a first inoperative position it is supported simultaneously at said first and second radial wall portions of said ring holder and whereby when said ring member is at a second operative position said first and second support surfaces thereof are equally spaced from said upper and lower supporting surfaces, respectively, of said ring holder to provide an open and unencumbered path for air flow therebetween;

(c) air distribution means for selectively introducing pressurized air into said spacing between said circular wall portions of said ring holder and said ring member to cause upward movement of said ring member from said inoperative position thereof to said operating position thereof; and (d) air barrier means located only adjacent the radially innermost ends of said second radial wall portions of said ring holder and said ring member and disposed directly in said path of air flow therebetween to reduce the quantity of said air flow therebetween and to thereby cause a greater quantity of air flow through said open and unencumbered path between said first supporting surface of said ring holder and said first support surface of said ring member.

2. An air-bearing supported spinning or twisting ring apparatus as defined in claim 1 and further characterized in that said air barrier means comprises an annular lip fixed to radially innermost end of said second radial wall portion of said ring holder and extending upwardly beyond and in spaced relation to the radially innermost end of said second radial wall portion of said ring member.

3. An air-bearing supported spinning or twisting ring apparatus as defined in claim 1 and further characterized in that said barrier means comprises an annular lip fixed to the radially innermost end of said second radial wall portion of said ring member and extending downwardly beyond and in closely spaced relation to the radially innermost end of said second radial wall portion of said ring holder.

4. A air-bearing supported spinning or twisting ring apparatus as defined in claim 1 and further characterized in that air distribution means includes an air blower air conduit means extending between said blower and said spacing between said circular wall portions of said ring member and said ring holder, and valve means disposed in said air conduit means and selectively operable between a first position at which the pressure side of said blower is maintained in fluid communication with said spacing to introduce pressurized air thereinto and a second position in which the suction side of said blower is maintained in fluid communication with said spacing to impose a vacuum therein.

* * * * *